US007497666B2

(12) United States Patent
Garris, Jr.

(10) Patent No.: US 7,497,666 B2
(45) Date of Patent: Mar. 3, 2009

(54) PRESSURE EXCHANGE EJECTOR

(75) Inventor: Charles A. Garris, Jr., Oakton, VA (US)

(73) Assignee: George Washington University, Washington, DC (US)

( * ) Notice: Subject to any disclaimer, the term of this patent is extended or adjusted under 35 U.S.C. 154(b) by 413 days.

(21) Appl. No.: 11/231,083

(22) Filed: Sep. 20, 2005

(65) Prior Publication Data

US 2006/0239831 A1 Oct. 26, 2006

Related U.S. Application Data

(60) Provisional application No. 60/611,582, filed on Sep. 21, 2004.

(51) Int. Cl.
*F04F 5/48* (2006.01)

(52) U.S. Cl. ..... 417/182; 417/174; 417/178; 60/649; 62/500

(58) Field of Classification Search ..... 417/64, 417/65, 76, 78, 182, 196, 194; 415/181, 415/191, 192, 202, 208.2; 416/234, 235, 416/237, 242, 243; 60/39, 45
See application file for complete search history.

(56) References Cited

U.S. PATENT DOCUMENTS 3,046,732 A 7/1962 Foa
4,048,820 A * 9/1977 Pielemeier ..... 68/133
4,203,569 A * 5/1980 Marks ..... 244/3.23
4,595,344 A * 6/1986 Briley ..... 417/185
5,647,221 A 7/1997 Garris, Jr.
6,138,456 A * 10/2000 Garris ..... 60/649
6,162,021 A * 12/2000 Sarshar et al. ..... 417/174
6,270,321 B1 * 8/2001 Schulte ..... 417/186
6,314,951 B1 * 11/2001 Wenger et al. ..... 123/559.2
6,430,917 B1 * 8/2002 Platts ..... 60/39.43
6,434,943 B1 8/2002 Garris, Jr.
6,499,288 B1 * 12/2002 Knight ..... 60/211
6,659,731 B1 * 12/2003 Hauge ..... 417/64
2004/0172966 A1 * 9/2004 Ozaki et al. ..... 62/500
2005/0002797 A1 * 1/2005 Morishima ..... 417/182

OTHER PUBLICATIONS

Foa, J.V.: "Elements of Flight Propulsion," John Wiley & Sons, Newy York, 1960; Chapter 10 "Pressure Exchange."

* cited by examiner

*Primary Examiner*—Devon C Kramer
*Assistant Examiner*—Amene S Bayou

(57) ABSTRACT

A novel pressure-exchange ejector is disclosed whereby a high energy primary fluid transports and pressurizes a lower energy secondary fluid through direct fluid-fluid momentum exchange. The pressure-exchange ejector utilizes non-steady flow principles and both supersonic flow and subsonic flow embodiments are disclosed. The invention provides an ejector-compressor/pump which can attain substantially higher adiabatic efficiencies than conventional ejectors while retaining much of the simplicity of construction and the low manufacturing cost of a conventional ejector. Embodiments are shown which are appropriate for gas compression applications such as are found in ejector refrigeration, fuel cell pressurization, water desalinization, and power generation topping cycles, and for liquid pumping applications such as marine jet propulsion and slurry pumping.

10 Claims, 13 Drawing Sheets

Prior Art

PRESSURE EXCHANGE EJECTOR

CROSS-REFERENCE TO RELATED APPLICATIONS

Provisional Patent 60/611,582, Filed Sep. 21, 2004

FIELD OF INVENTION

This invention relates to ejector compressors and, in particular, to their application to environmentally beneficial and energy efficient technologies in refrigeration and power generation.

BACKGROUND OF INVENTION

In FIG. 1 is shown a conventional ejector, well known in the prior art. This pumping device has the advantage of extreme simplicity, there being no moving parts. The principle of operation is that the high energy primary fluid entering the ejector through primary fluid inlet conduit 2, passes through a supersonic nozzle 5, and emerges therefrom as a high speed jet. Upon exiting said supersonic nozzle, the primary jet entrains secondary fluid introduced through secondary fluid inlet conduit 3 into plenum 24 through the action of turbulent mixing between primary and secondary fluid. The mixing and subsequent diffusion is controlled by aerodynamic shroud 10 and the mixed flow is discharged from the ejector at mixed-fluid outlet conduit 4. The conventional ejector, as a result of its simplicity, finds application in numerous technologies. Nevertheless, it suffers from low efficiency as a result of the inherent irreversibility of the mechanism with which it operates: turbulent mixing. Despite a century of research on improving this device, its performance is limited by the nature of the physics of its operation.

Foa (U.S. Pat. No. 3,046,732) and Garris (U.S. Pat. No. 5,647,221) disclosed new types of ejectors which operate on a different principle from conventional ejectors: pressure-exchange. Due to the thermodynamically reversible nature of pressure-exchange, much higher efficiencies can be obtained, thereby making possible a new level of performance. Foa (U.S. Pat. No. 3,046,732) and Garris (U.S. Pat. No. 5,647,221) have discussed the fact that pressure-exchange is a different process which is thermodynamically reversible because it is based on the work of interface pressure forces as opposed to highly dissipative process of turbulent mixing. They further disclosed ejectors which utilize both the pressure-exchange mechanism in addition to the turbulent mixing mechanism.

A figure of merit on ejector performance is provided by comparing the performance of an ejector with the ideal turbo-machinery analog of an ejector. In the turbo-machinery analog, shown in FIG. 2; a turbine (expander) 83 directly drives a compressor 84 through its output shaft 85, said turbine being energized by a high pressure primary fluid which is introduced through inlet conduit 2, and the compressor taking suction through inlet conduit 3 from a source of relatively low energy secondary fluid which is to be energized, both compressor 84 and turbine 83 discharging into a common exit passage 4 (connection between turbine discharge and compressor discharge not shown.) If the processes occurring in the turbo-machinery are assumed to occur isentropically and thermodynamically reversibly, the adiabatic efficiency obtained is optimal. Since real conventional ejectors depend on irreversible processes, their adiabatic efficiencies are a small fraction of the turbo-machinery analog.

The concept of using turbo-machinery in place of ejectors to improve efficiency is known in the art. This is termed the "turbo-machinery analog". Rice et al (U.S. Pat. No. 3,259,176) disclosed the use of the turbo-machinery analog in a refrigeration system which is equivalent to an ejector refrigeration system but with the ejector replaced by the turbo-machinery analog. However, the advantage of the conventional ejector is its simplicity. The conventional ejector has no moving parts, whereas, equivalent turbo-machinery requires a high precision product using advanced materials, and which is very costly. Utilizing the turbo-machinery analog in refrigeration applications would require very large and costly machinery if low density refrigerants were used. Furthermore, topping cycles utilizing the turbo-machinery analog would not be able to handle the high temperature working fluids better than standard turbo-machinery. Hence, for these applications, the turbo-machinery analog would not be adequate. An objective of the present invention is to provide an ejector which satisfies the need for high efficiency through the use of pressure-exchange, approaching the efficiency of the ideal turbo-machinery analog, yet which retains much of the simplicity of the conventional ejector.

Foa (U.S. Pat. No. 3,046,732) invented an ejector which utilized the benefits of pressure exchange through the use of rotating primary jets. He further showed how the rotating primary jets, when incorporated into a rotor, could be made self-actuating by means of canting the nozzles at an angle with respect to the azimuthal plane. Garris (U.S. Pat. No. 5,647,221) taught how when the working fluid was compressible, shock and expansion wave patterns could be used to advantage in effecting flow induction by pressure-exchange. Garris (U.S. Pat. No. 5,647,221) further taught how pressure-exchange ejectors might effectively be utilized in ejector refrigeration. While these prior art devices offer effective aerodynamic means to provide excellent use of pressure-exchange to affect flow induction, they are deficient in that they require a very high degree of precision in manufacturing to provide the level of sealing necessary while allowing the rotor to spin at the high angular velocities necessary to achieve effective pressure-exchange. Furthermore, in these prior-art pressure-exchange ejectors, the demands on the rotor thrust-bearing are very high due to the high internal supply pressure and the low external suction pressure occurring simultaneously with very high rotor angular velocities. This very demanding combination of requirements for sealing, high rotational speeds, and thrust bearing tend to substantially increase the cost of the device and reduce its potential service life. Garris (U.S. Pat. No. 6,138,456) taught how the sealing requirements implicit in the use of rotating nozzles can be eliminated while the thrust demands substantially alleviated by the use of a self-driven rotating vane ejector where the vanes have aerodynamic shapes consistent with supersonic flow. In the embodiments shown by Garris (U.S. Pat. No. 6,138,456), the vanes assumed the form of sharp edged wedges placed peripherally around the rotor and at an angle to the axial plane so as to enable the self-driving features. Garris further taught that the best mode was for the rotor to turn at its free-spinning speed; viz., the speed that occurs when there is no bearing friction and the flow paths of the fluid particles emanating from the primary flow are in the axial plane in the laboratory frame of reference. Garris further taught that the presence of supersonic flow structure such as shock waves and expansion fans does not prevent the exploitation of the reversible work of interface pressure forces provided in the pressure exchange process. However, although computer simulations and experimental results on the wedge-type vaned rotor did succeed in showing the benefits of pressure exchange, the wedge design of the rotor vanes may be too thin to provide a rotating periodic flow structure to optimally utilize pressure exchange. An objective of the present invention to obtain a pressure exchange ejector which provides improved performance in the transfer of momentum and energy from the primary to the secondary fluid by providing a more robust primary-secondary interface. It is therefore the principal objective of the present invention to provide an ejector which effectively exploits pressure-exchange for flow induction, yet is less demanding with regard to sealing, thrust management, and high rotational speeds. Another objective of the present invention is to provide a pressure-exchange ejector which is simple and economical to manufacture. Still another objective of the present invention is to provide a pressure-exchange ejector which is suitable for compressor applications such as ejector refrigeration, fuel cell pressurization, water desalinization, applications and power generation topping-cycle use for both gas turbines and Rankine cycle systems. While pressure-exchange ejectors can find considerable use in gas and vapor compression applications, and in that connection, the benefits of supersonic gas flow can be effectively utilized, pressure-exchange can also be effectively utilized in incompressible fluids such as liquids for pumping applications such as water-jet marine propulsion. It is also an object of this invention to provide an ejector for use in liquid pumping applications such as water jet marine propulsion.

SUMMARY OF INVENTION

In the development of new technologies which will enable us to continue to enjoy our prosperity yet preserve the environment, there has been a need for high efficiency ejectors in the following areas:

1. Refrigeration/air conditioning.
2. Gas Turbine engines.
3. Rankine Cycle engines.
4. Water desaliniazation
5. Fuel cell pressurization.

These areas of technology are responsible for a very high percentage of the energy we consume and the pollution we create, particularly with regard to greenhouse gases and ozone layer depleting chemicals. Progress in beneficially utilizing ejectors has been hampered by their inherently low efficiency due to the fundamental operating mechanism of turbulent entrainment in the case of conventional ejectors, or by difficulties in mechanical design under the combined requirements of high thrust—high angular velocity—efficient sealing for the case of prior art pressure exchange ejectors.

The present invention provides a pressure-exchange ejector capable of substantially higher efficiencies than hitherto possible with conventional ejectors. Following Foa (Elements of Flight Propulsion, pg 223, Wiley, 1960), "pressure-exchange" may be defined herein as any process where a body of fluid is compressed by pressure forces that are exerted on it by another body of fluid that is expanding. Since pressure-exchange is a thermodynamically reversible process as opposed to turbulent mixing, energy dissipation in pressure-exchange ejectors can be substantially reduced.

By the use of the principles of supersonic aerodynamics, the mechanical complexity of the prior art pressure-exchange ejectors is reduced, and the demands for sealing and thrust management are significantly assuaged. As a result of the lower stresses and the avoidance of sealing, the pressure-exchange ejector provided herein is capable of operating at extremely high temperatures.

In the preferred embodiment of the instant invention, a primary-fluid comprising a compressible gas or vapor at a high stagnation pressure is introduced through suitable piping to a housing at the location of a primary-fluid inlet conduit. Said primary-fluid is then conducted to a nozzle whereby it is accelerated to high speeds. As a result of the acceleration, the static pressure of the primary fluid at the discharge of the nozzle is substantially reduced. The primary flow will then impinge upon a conical fore-body. If the fluid is compressible and the primary flow is supersonic, the best mode has a conical fore-body with an included angle sufficiently small so as to produce an attached leading shock wave at the apex and to enable the flow to continue supersonically downstream of said attached leading shock. However, the invention is still effective if the flow is subsonic and even if the fluid is incompressible with supersonic flow phenomena totally absent. Furthermore, the invention does not require that the fore-body be conical but only that it be axi-symmetric with respect to the axis of rotation. Following the conical forebody is placed a rapidly spinning rotor, generally having a conical or ogive shape, but having a multiplicity of ramp-shaped vanes which deflect selected portions of the incoming primary fluid. The deflected primary fluid impinges on a shroud creating a rotating helical barrier or wall of primary fluid.

The fore-body may be integral with the rotor and rotate, or it can be connected in a non-rotating but coaxial manner. The rotor is supported by a spindle/actuator which is mounted in an aerodynamically shaped centerbody which is rigidly mounted in the center of a cylindrical housing by means of a plurality of bracing aerodynamic struts which provide support yet allow the combined primary and secondary fluids to pass through to the discharge. The spindle/actuator includes an output shaft to which the rotor is mounted, radial bearings and thrust bearings supporting the loads of the rotating output shaft, and may include a power driven actuator such as an electrical motor. Since the ramp-shaped vanes are generally canted at a helix angle, the incoming primary flow generally drives the rotor without the need for external energy. However, it is anticipated that a designer may wish to include a motor in the spindle/actuator to facilitate overcoming bearing friction and to actively modify the rotational speed to be greater or less than the ideal free-spinning speed in accordance with operating conditions.

A secondary-fluid is introduced to the said housing through suitable piping into a plenum and then conducted to the vicinity of the nozzle discharge. An aerodynamic shroud further directs the secondary fluid into the vicinity of the rotor vanes and associated shock and expansion fan structure. The said deflected primary fluid forming a rotating helical barrier or wall of primary fluid entraps the secondary fluid between the helical interstices and energizes the secondary fluid by virtue of the pressure forces acting on the primary-secondary fluid interface. Thus, momentum will be exchanged between the primary-fluid and the secondary-fluid at the interfaces between said primary fluid and said secondary fluid through pressure exchange. After pressure-exchange occurs, the primary and secondary fluid are mixed and diffused to subsonic speeds before being transported to the mixed-fluid outlet conduit. At the discharge, the specific energy, and stagnation pressure, of the mixed discharge flow will be greater than that of the secondary flow, but less than that of the primary flow. This energized and compressed fluid may now be used for its intended application.

DESCRIPTION OF THE PREFERRED EMBODIMENTS

Figure 1:
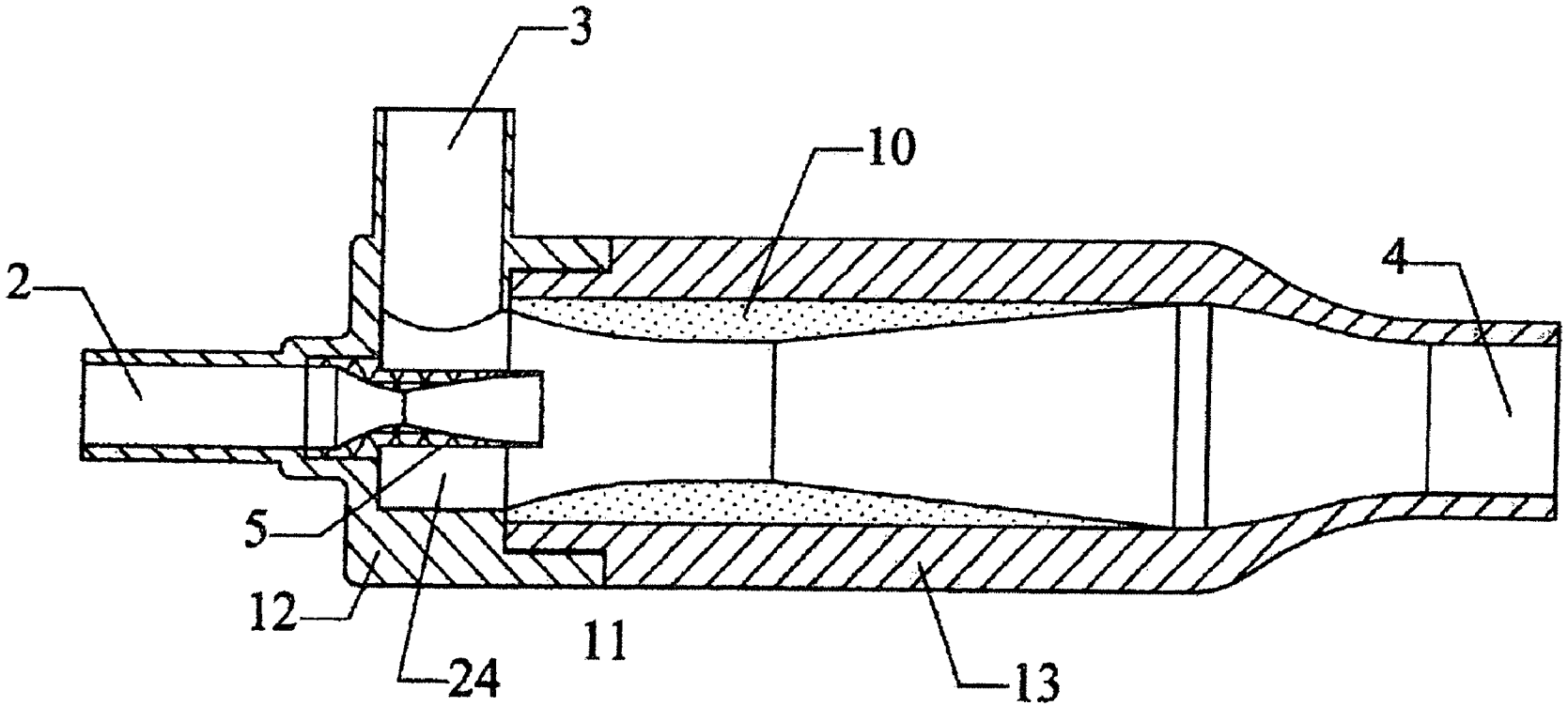
FIG. 1 shows a longitudinal sectional elevation of a prior art conventional ejector.
Figure 2:
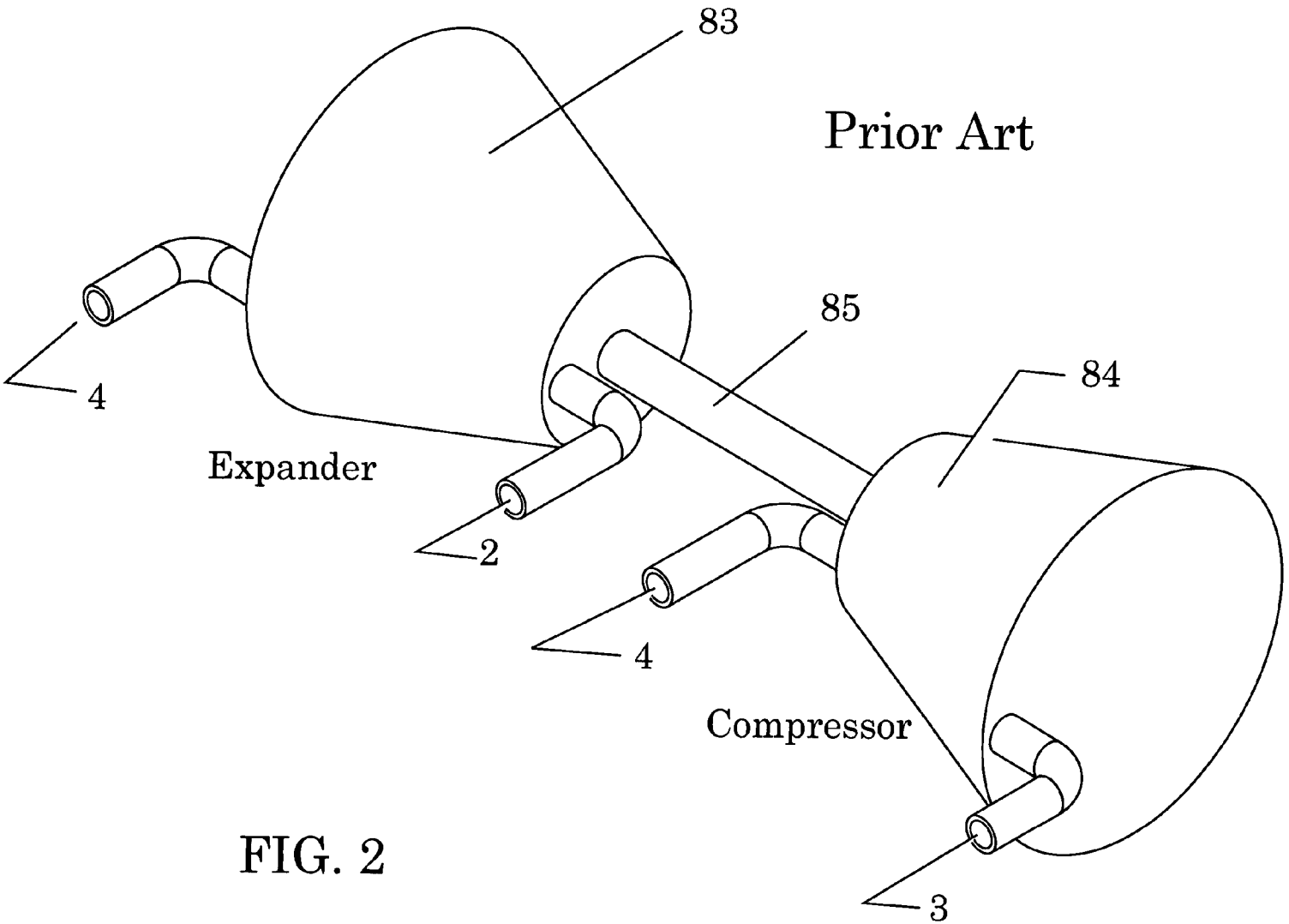
FIG. 2 is a scematic of the turbomachinery analog of an ejector.
Figure 4:
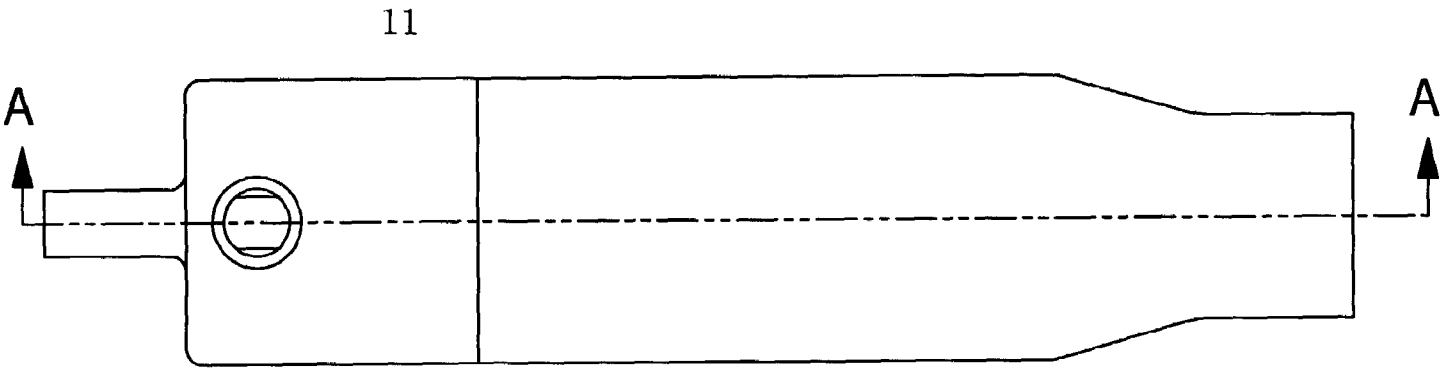
FIG. 4 is a longitudinal sectional elevation of the invention shown in FIG. 2.
Figure 3:
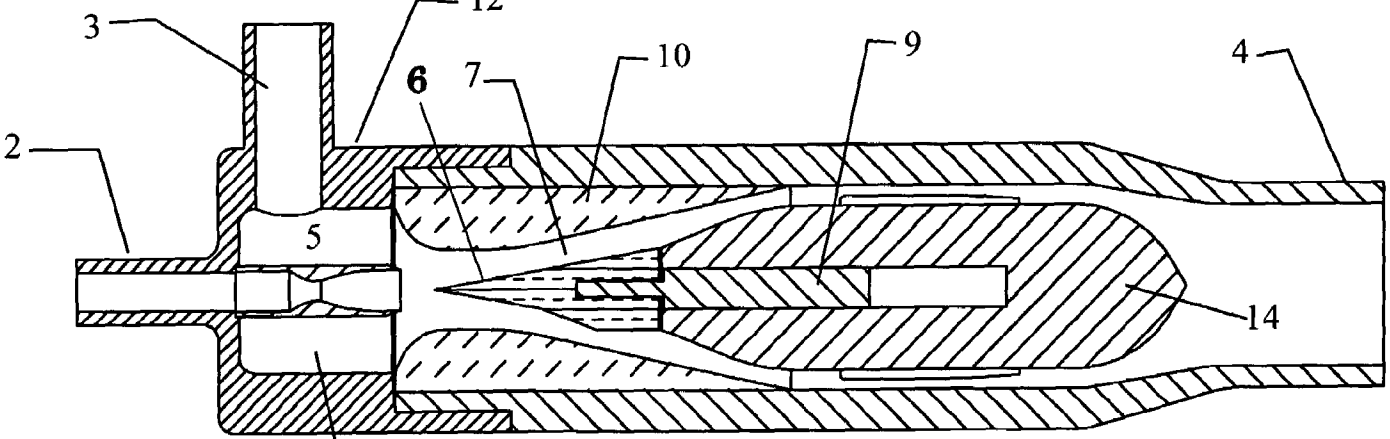
FIG. 3 is a longitudinal external top view of the invention.
Figure 5:
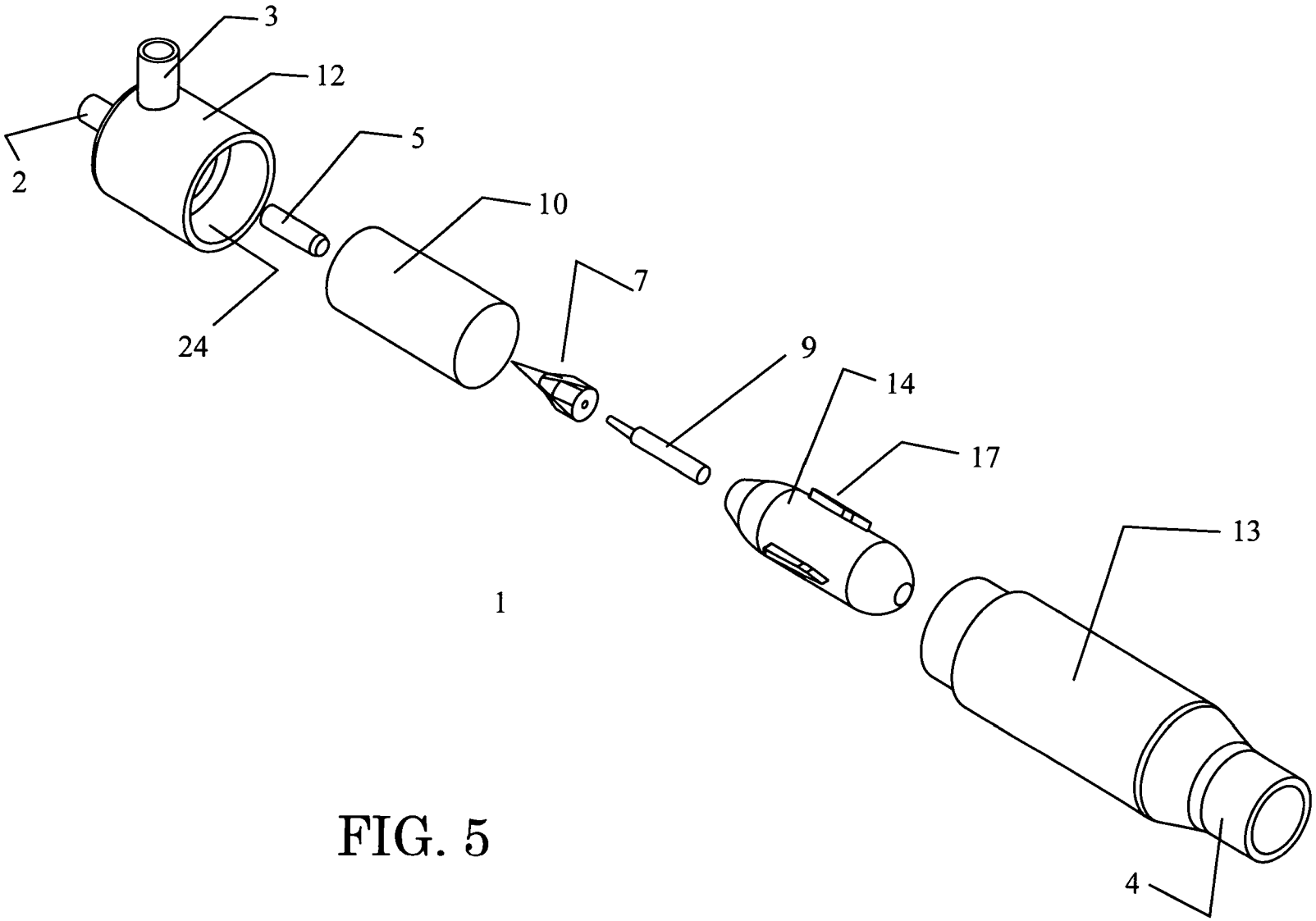
FIG. 5 is an exploded view of the embodiment of FIG. 2 showing each component.
Figure 6:
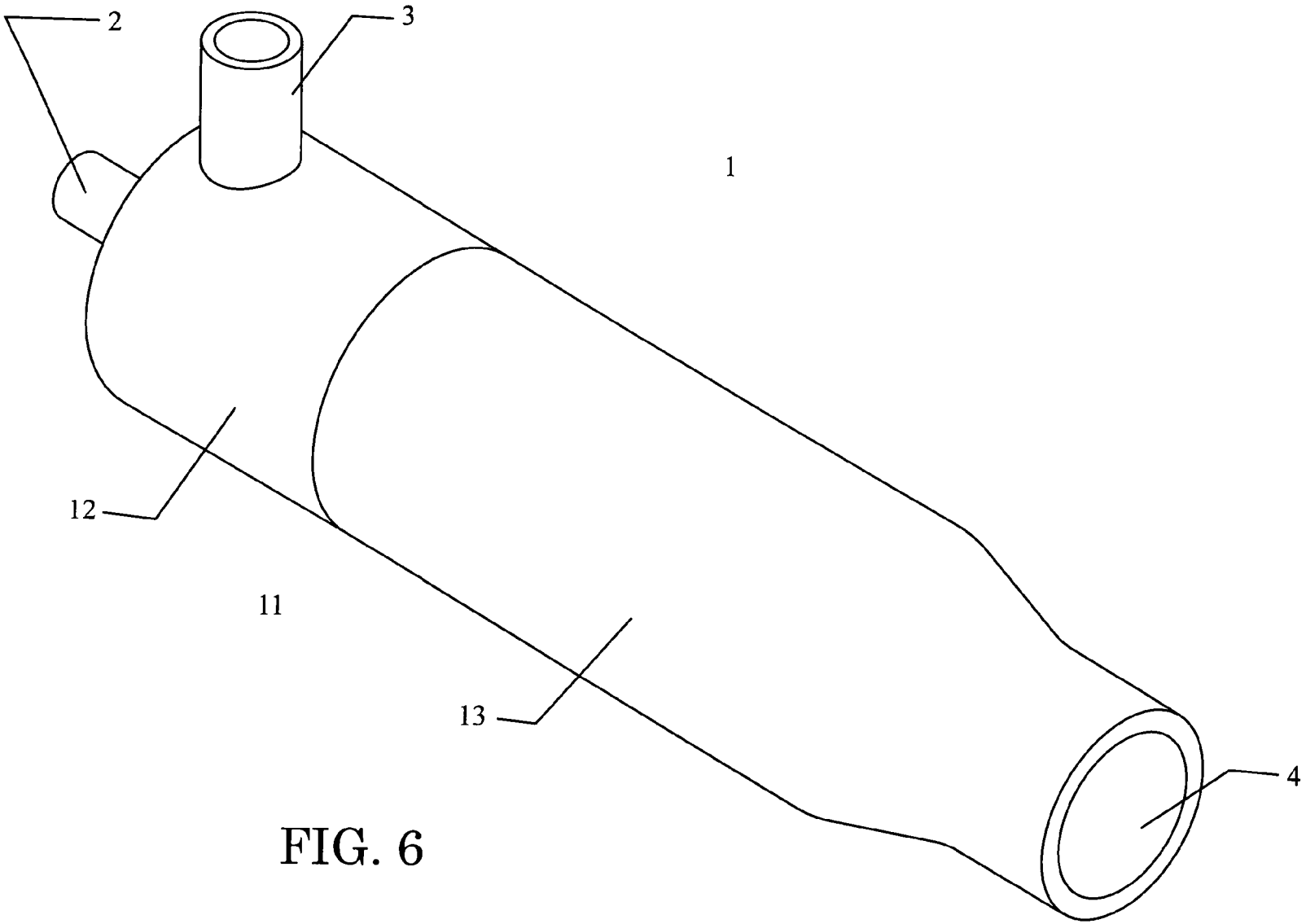
FIG. 6 shows an isometric projection of an external view of the invention of FIG. 2.
Figure 7:
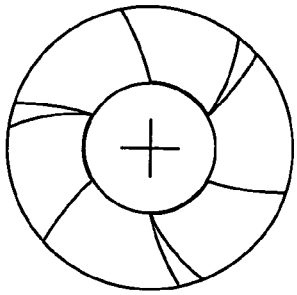
FIG. 7 is a front view of a representative first embodiment rotor.
Figure 8:
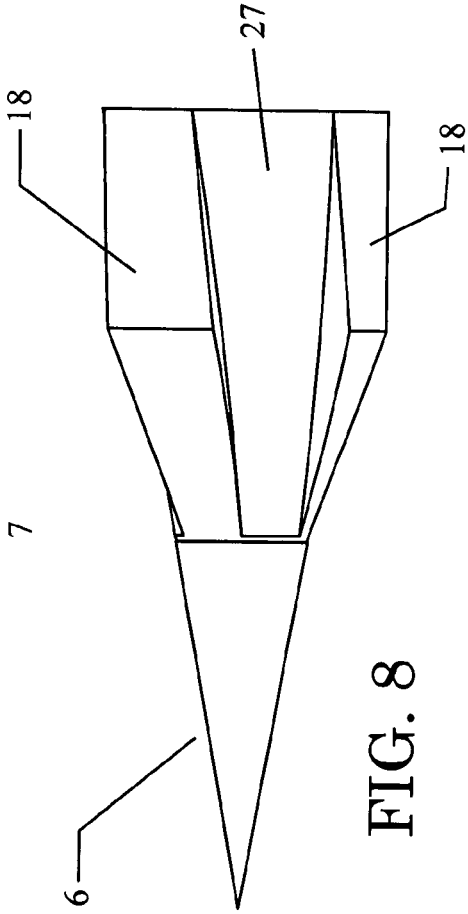
FIG. 8 is a side view of the same rotor shown in FIG. 6.
Figure 9:
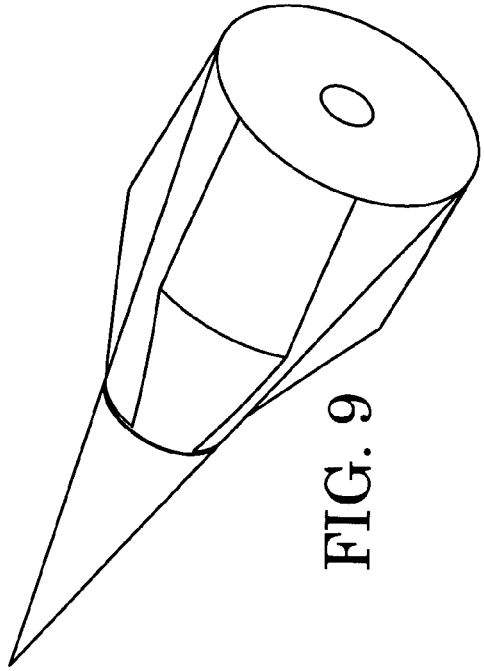
FIG. 9 is a rear angled view of the same rotor shown in FIG. 6.
Figure 10:
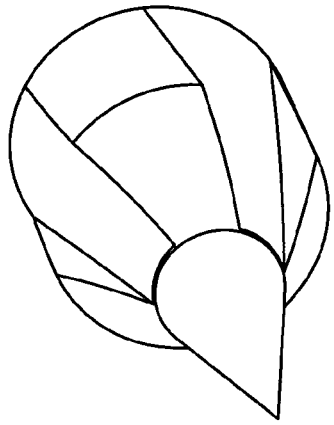
FIG. 10 is a front angled view of the same rotor shown in FIG. 6.
Figure 11:
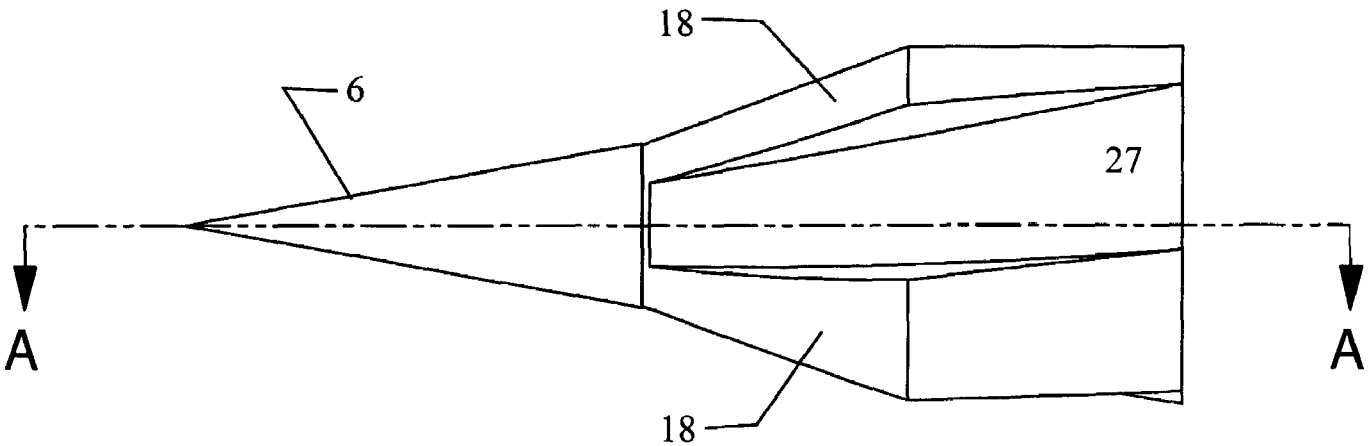
FIG. 11 is a top view of the rotor shown in FIG. 6.
Figure 12:
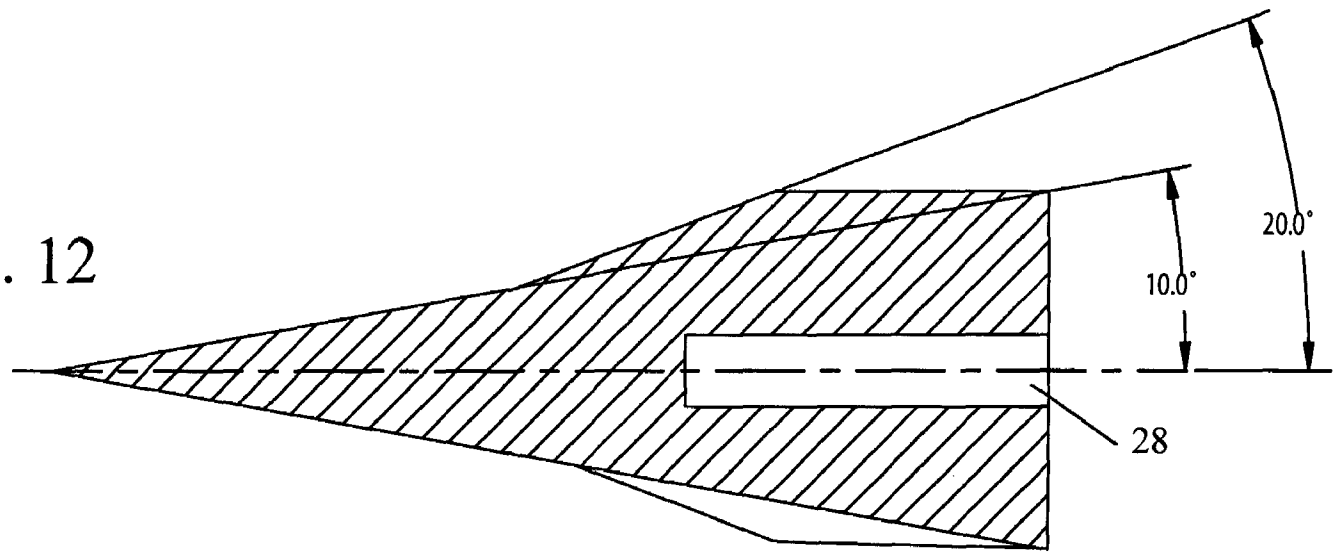
FIG. 12 is a section view of the rotor corresponding to FIG. 10 showing the angles for a particular embodiment and the recess for the shaft.

A preferred embodiment of the novel pressure-exchange ejector disclosed herein is shown in a longitudinal sectional elevation in FIG. 3, in an exploded view in FIG. 5, and in an external assembly view in FIG. 6. Ejector 1 is enclosed by a housing 11 which is shown consisting of an upstream section 12 and a downstream section 13 which are connected in a manner so as to provide structural rigidity and sealing, as would be provided by a threaded connection among other common methods, yet permit separation of said upstream and downstream sections in a manner convenient for assembly and disassembly. Said upstream section 12 provides a primary fluid inlet conduit 2 and a secondary fluid inlet conduit 3, a rigid support for supersonic nozzle 5, and a secondary fluid plenum 24. Said downstream section of the housing 13 provides rigid support for aerodynamic shrouds 10, rigid mount for the centerbody 14, and an outlet conduit 4 for the mixed fluid. A compressible energetic primary fluid is introduced through said inlet conduit 2 and directed to converging-diverging supersonic nozzle 5 whereby the primary fluid is accelerated to supersonic speeds. It is known that when the stagnation pressure upstream of a converging-diverging supersonic nozzle is above a certain critical value, the Mach number of the compressible fluid discharging from the nozzle is determined by the thermophysical properties of the working fluid and the ratio of the exit area to the throat area of said supersonic nozzle 5. When the working fluid is air, the supersonic nozzle 5 shown in FIG. 3 is a Mach 3.0 nozzle. However, a designer skilled in the art might select a nozzle of higher or lower Mach number depending on his/her design objectives. The less energetic secondary fluid is introduced through inlet conduit 3, passing through a plenum 24 which distributes the secondary fluid in an axi-symmetric manner around the exterior of supersonic nozzle 5 prior to being conducted downstream for pressure-exchange with the primary fluid. The supersonic primary fluid emanating from the exit of supersonic nozzle 5 impinges upon a conical fore-body 6 in such a manner that an attached conically-shaped oblique fore-body shock wave forms at the apex of said fore-body 6. As explained in Garris (U.S. Pat. No. 6,138,456), and well known to those skilled in the art, the angle of the fore-body shock is a function of the Mach number of said primary fluid exiting from said supersonic nozzle 5, the thermo-physical properties of said fluid, and the fore-body cone angle. The cone angle is selected to be small enough to insure that the fore-body shock is weak and is attached to the apex of said fore-body. One skilled in the art could easily determine these conditions using methods described in standard compressible aerodynamics texts. Since the fore-body shock is weak, the flow behind said fore-body shock is preferably supersonic, although at a lower Mach number than the fluid upstream of said fore-body shock, and is forced to change direction so as to follow the contour of the fore-body 6. Immediately downstream of the fore-body 6 is a rotor 7 which is pivotally mounted so as to enable it to freely spin about the longitudinal axis of shaft 9. In the preferred embodiment, the fore-body 6 is integral to the rotor 7 and therefore rotates with the rotor, but the fore-body 6 can also be configured to be stationary with respect to the housing 11. This minimizes the inertia of the rotating components. In the preferred embodiment shown, the shaft 19 is rigidly connected to the rotor 7 and the fore-body cone 6 while the shaft 19 is pivotally connected to the spindle 9. In other embodiments of this invention, the shaft 19 may be rigidly connected to the rotor 7 and fore-body 6, but pivotally connected to said spindle 9. As seen in FIGS. 3, 5, 7, 8, and 9 in the preferred embodiments, the body 27 of the rotor 7 has the shape of the frustum of a cone whose included angle is equal to that of the fore-body 6 and whose conical surface is approximately contiguous with that of the adjacent fore-body 6 so as to provide a smooth transitional flow path as the fluid progresses from the vicinity of the fore-body 6 to the vicinity of the rotor. Upon the conical surface of the rotor 27, a plurality of ramp-shaped vanes 18 are fixedly attached axi-symmetrically about the central longitudinal axis of rotor 7. The number of vanes 18 utilized can vary from two to a multitude, the number being determined by the pressure rise and mass flow ratio desired from the pressure-exchange ejector 1, as well as the diameter of the rotor 7. In the preferred embodiment shown, three vanes were selected. In FIG. 12 are shown the geometrical attributes of the vanes 18, the fore-body cone 6 and the conical surface of the rotor 27 and their interrelations for the preferred embodiment. It is noted that in the preferred embodiment, the vanes 18 have a ramp-shaped leading edge which develops into a conical surface whose included angle is greater than that of the fore-body 6. In the embodiment shown, this angle is 20°, however, this a design parameter that can vary substantially in accordance with the application. While the preferred embodiment has vanes with a portion of the outer surface being conical and the remainder being cylindrical as shown in FIGS. 7-12, it is anticipated that the vanes could be angled in the tangential direction or could have outer surface shapes other than conical and cylindrical. One skilled in the art might choose an outer vane shape having a complex mathematical relationship and having an outermost part at a radius greater than that of the base of the rotor. Furthermore, in the preferred embodiment shown in FIG. 8, in order to avoid the generation of unnecessary losses through a "paddling effect" resulting from the vanes 18 extending outside of the fore-body shock, the outermost edges of the vanes 18, extend radially in such a manner so as to approximately correspond to the extended location of the fore-body shock.

Figure 13:
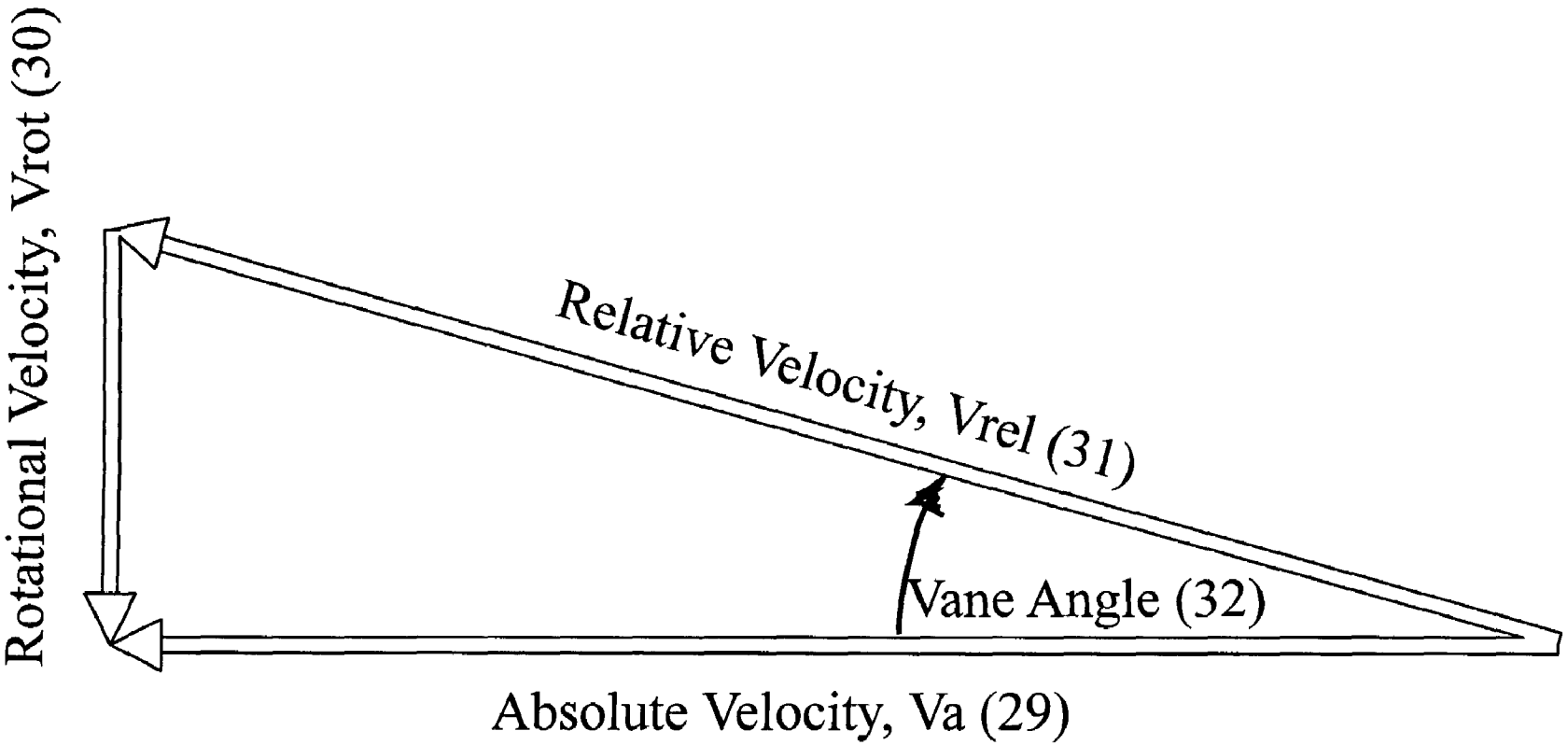
FIG. 13 is a velocity vector diagram showing the relationships needed to determine the local vane angles.

In FIGS. 3, 5, 7, 8, 9, 10, 11, and 12 it is seen that the vanes 18 are canted with respect to the axial-longitudinal plane. The angle to which the vane makes with the axial-longitudinal plane varies with axial position. The scope of the invention includes any possible variation of the vane angle with axial position, however, the best mode is one which would not cause a tangential deflection of the primary fluid during the period in which a fluid particle is traversing the rotor flow path. This is to say that in the laboratory frame of reference, the best mode is the one in which the primary fluid velocity in the laboratory frame of reference is in the axial plane. FIG. 13 shows a vector diagram which would enable one of ordinary skill in the art to calculate the vane angle at a given axial position on the rotor, given the local primary fluid velocity 29 in the laboratory frame of reference, the radial position of the base of the vane from the axis of rotation, and the design angular velocity. The rotational velocity 30 seen in FIG. 13 is the product of the radius and the angular velocity. Compressible flow theory teaches that for an ideal gas with negligible viscosity, when the rotor surface 27 is conical, the absolute velocity of the primary fluid passing over the rotor and between the vanes has a constant velocity over the rotor surface and can be determined from conventional tables or standard computational fluid dynamics methods. For a conical rotor base 27, the rotational velocity 30 varies with radius. Hence, the velocity triangle shown in FIG. 13 changes with axial location on the rotor. The relative velocity 31 of the primary fluid, as seen from the rotating rotor-fixed frame of reference, must be tangential to the vane, hence the local vane angle 32 is the same as the angle between the absolute velocity 29 and the relative velocity 31. Although the scope of this invention is in no way limited by the geometrical parameters shown in the preferred embodiments, the results of a sample calculation of vane angle under the free-spinning best mode is shown in in Table I. The working fluid, the nozzle Mach number, the total pressures and temperatures, and the rotational speed are selected arbitrarily for the purpose of providing an example. However, it is anticipated that this invention would be applicable to many applications requiring different working fluids and very different operating conditions. While in the best mode, the flow is supersonic upstream of the fore-body and over the surface of the rotor, it is anticipated that the invention would function even if the flow were subsonic at points over the surface 27 of the rotor, or even if the flow emanating from the nozzle were subsonic and there is no shock wave at all. In fact, the invention would function even if the fluid were an incompressible liquid and there were no supersonic phenomena present.

In the best mode, the fluid is a compressible gas or vapor which emanates from the nozzle 5 at supersonic speeds. When the supersonic fluid stream passes over said canted vanes 18, free-spinning rotation is imparted to the rotor 7. The rotational speed that the rotor acquires is dependent upon the thermo-physical properties of the fluid, the Mach number of the fluid emanating from supersonic nozzle 5, the included angle of the fore-body cone 6, and the vane angle of the vanes 18. While the best mode is one where the rotor 7 is self-driven, the invention anticipates that one may wish to drive the rotor by means of a motor/actuator at speeds greater than or less than the ideal free-spinning speed. The presence of undesirable friction will reduce the rotational speed of the rotor 7 from that of the ideal free-spinning condition, and one may wish to compensate for the dissipation in energy through bearing friction by means of a motor/actuator. When the supersonic fluid behind the fore-body shock and in the vicinity of the fore-body cone 6 contacts the leading edge of the ramped-shaped vane 18, a weak oblique vane-shock will form and the primary flow in the vicinity of the vanes will be deflected outwardly towards the shroud while the primary flow in the spaces between the vanes will continue to follow the conical contour 27 of the rotor. The flow pattern thus produced by the primary fluid will be such that a helix-shaped rotating body of primary fluid, extending radially between the rotor 7 and the shroud 10 will be formed.

TABLE I

Sample Calculation of Vane Angle for Free-Spinning Condition

Geometric Properties

Half cone angle = 10°;
Rotor Diameter: 1.058 in
Rotor length including fore-body: 3.0 in
Axial location of vane inception: 1.3 in
Design Rotational Speed = 75,000 rpm Fluid Properties Working fluid: Air
Shock half-angle: 21.8°

Upstream of Shock Wave

Primary Mach Number upstream of shock: 3.0
Total Primary Pressure: 90 psia;
Total Primary Temperature: 540° R On Surface (27) of Rotor Surface Mach Number behind shock: 2.740
Static Pressure: 3.813 psia
Absolute Velocity (29): 1,969.7 ft/s
Static Temperature: 214.3° R

| Axial Position from fore-body (6) apex, in | Radius of rotor surface (27), in | Rotational Velocity (30), ft/s | Vane Angle (32), degrees |
|---|---|---|---|
| 1.3 | .229 | 150.08 | 4.36 |
| 1.4 | .247 | 161.63 | 4.69 |
| 1.5 | .267 | 173.17 | 5.02 |
| 1.6 | .282 | 184.72 | 5.36 |
| 1.7 | .300 | 196.26 | 5.69 |
| 1.8 | .317 | 207.81 | 6.02 |
| 1.9 | .335 | 219.35 | 6.35 |
| 2.0 | .352 | 230.90 | 6.69 |
| 2.1 | .370 | 242.44 | 7.02 |
| 2.2 | .387 | 253.99 | 7.35 |
| 2.3 | .405 | 265.53 | 7.68 |
| 2.4 | .423 | 277.08 | 8.01 |
| 2.5 | .441 | 288.62 | 8.34 |
| 2.6 | .458 | 300.17 | 8.66 |
| 2.7 | .476 | 311.71 | 8.99 |
| 2.8 | .494 | 323.26 | 9.32 |
| 2.9 | .511 | 334.80 | 9.65 |
| 3.0 | .529 | 346.35 | 9.97 |

In a second embodiment of the invention, the pressure exchange ejector is designed for the transport of subsonic fluids, particularly liquids. Referring to FIG. 3, in such an application, the best mode would require that the nozzle 5 be converging, and the secondary fluid inlet plenum 24 would most likely be coaxial with the nozzle 5. The configuration of the fore-body 6 and the rotor vanes 18 would be similar, however, it is anticipated that the transitions from the fore-body 6 to the ramp-shaped vanes 18, and the transition from the vanes to the centerbody 14 would be gradual rather than abrupt, consistent with standard subsonic design. The shroud 10, would have a similar shape as with the supersonic case, and the shroud 10 diameter being sufficient to allow the secondary fluid to pass and enter the interstices between the primary fluid pseudo-blades. As with the supersonic case, the vane-angles should be designed to produce the "free-spinning" rotational speed. However, due to the slower subsonic nature of the primary fluid, it is expected that in most incompressible applications, due to the lower axial primary fluid velocity, the helix angle of the ramp-shaped vanes would be substantially higher than in the supersonic case.

It is further anticipated that the primary fluid may a gas or a vapor, while the secondary fluid is a liquid. Similarly, both primary and secondary fluids could be entirely different fluid substances.

Figure 15:
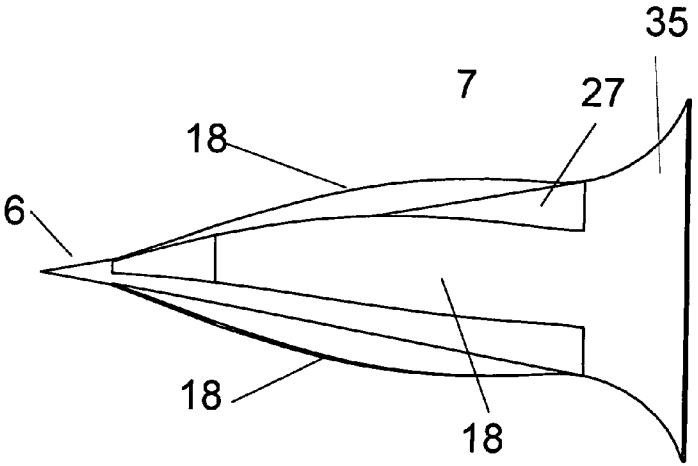
FIG. 15 is a side view of the same rotor shown in FIG. 13.
Figure 16:
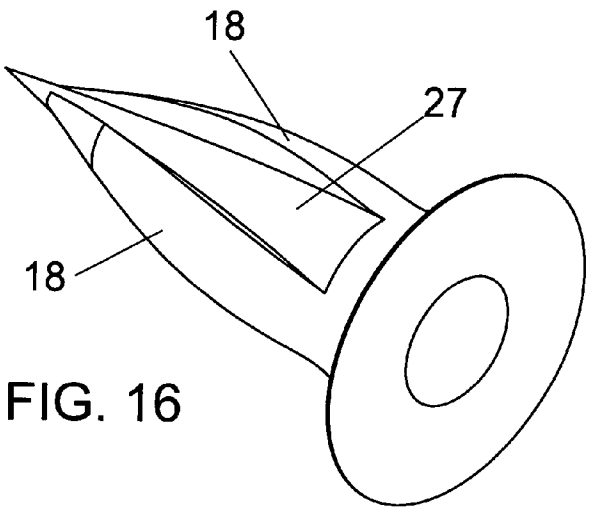
FIG. 16 is a rear angled view of the same rotor shown in FIG. 13.
Figure 17:
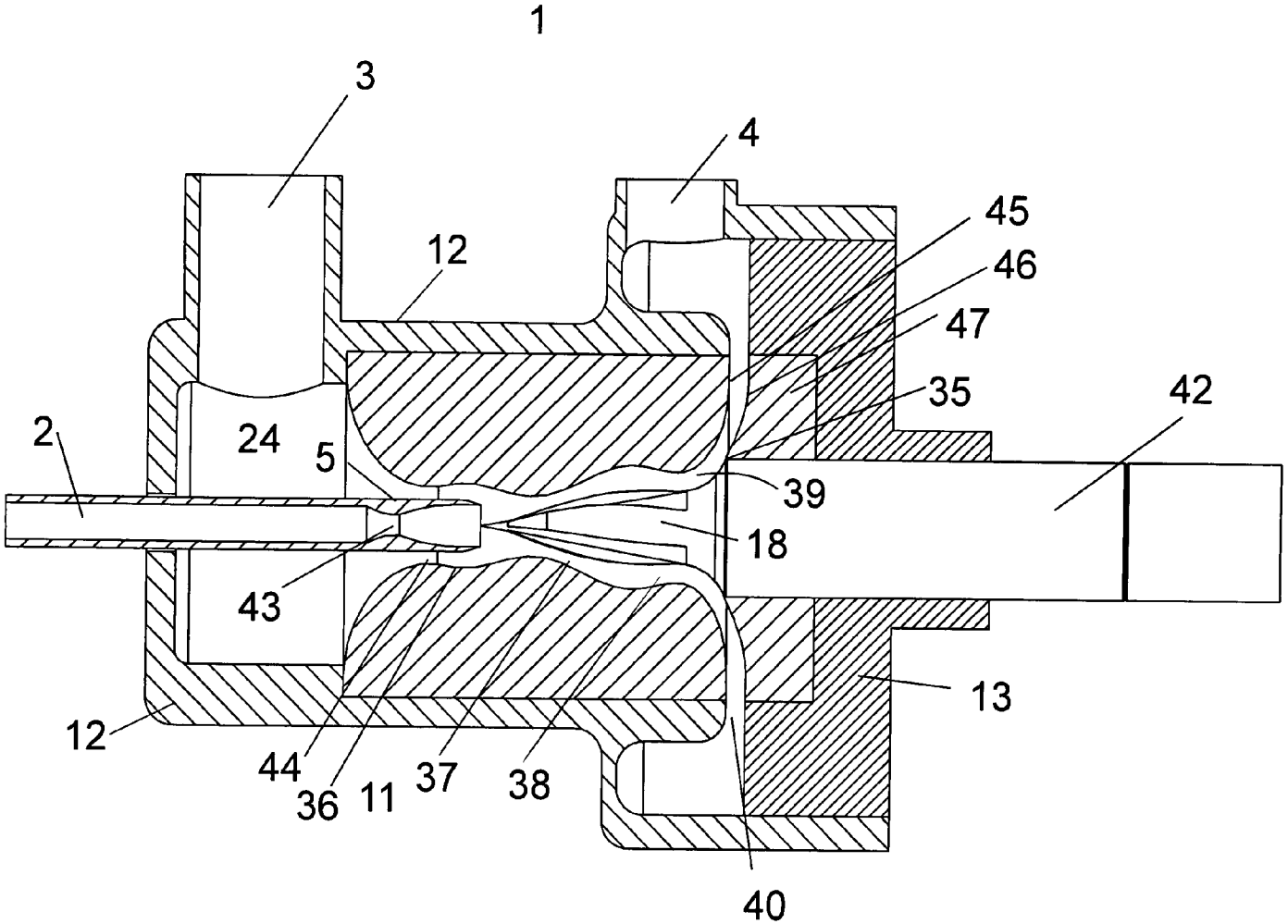
FIG. 17 is a side sectional view of a third embodiment pressure-exchange ejector.
Figure 18:
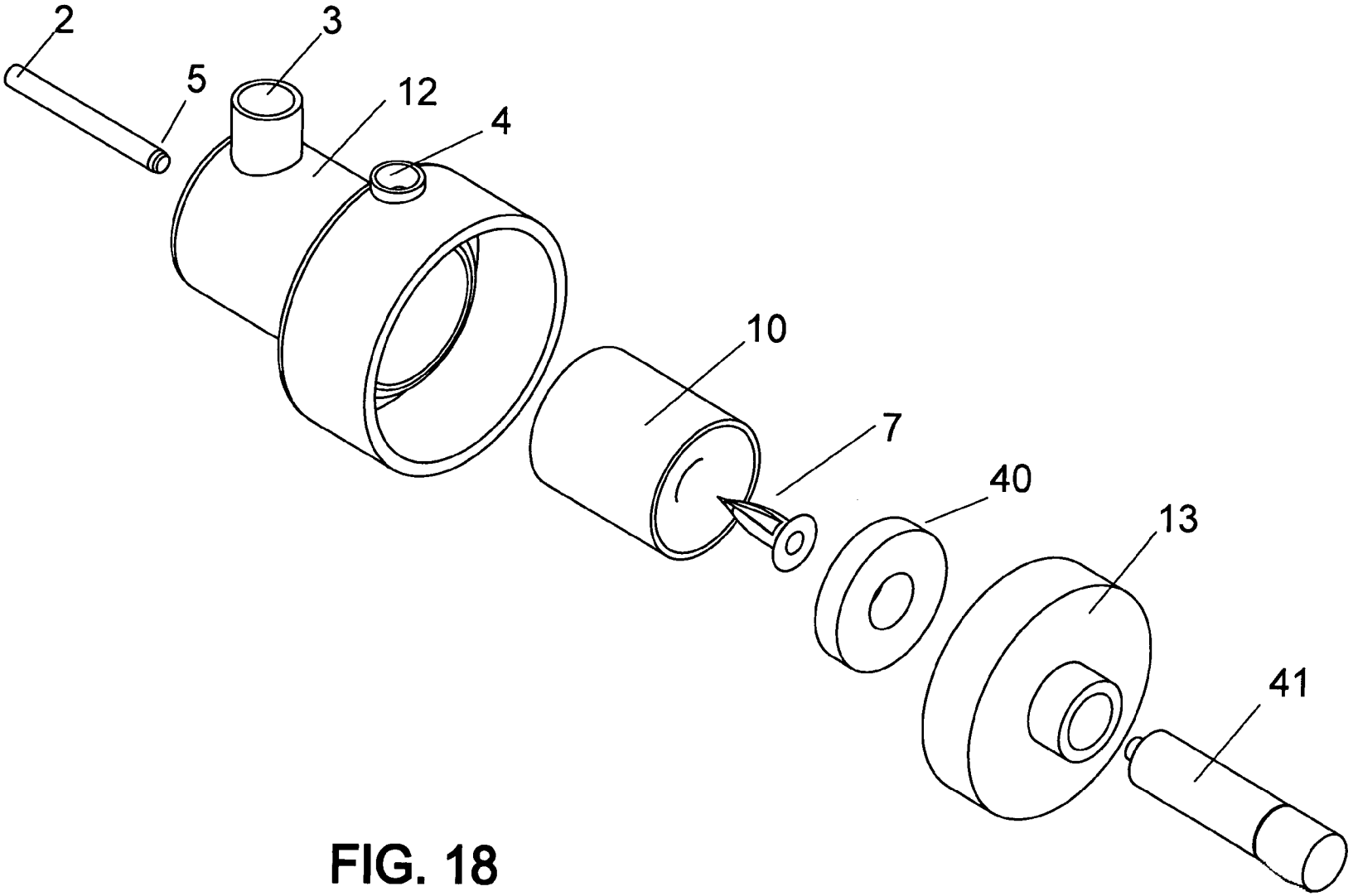
FIG. 18 is an exploded view of the same pressure exchange ejector shown in FIG. 16.
Figure 20:
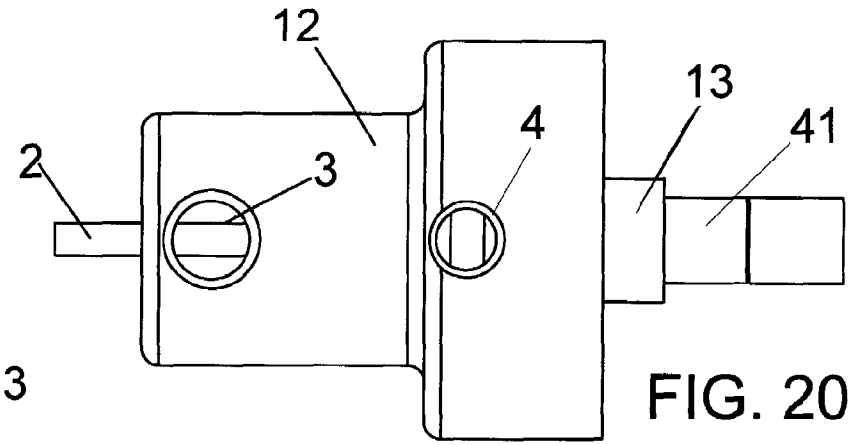
FIG. 20 is an external top view of the same embodiment shown in FIG. 16.
Figure 21:
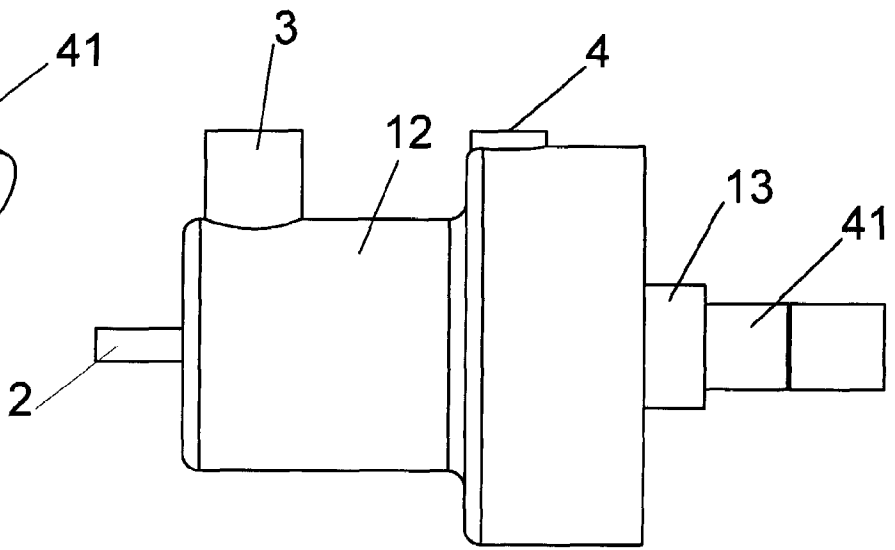
FIG. 21 is an external side view of the same embodiment shown in FIG. 16.
Figure 19:
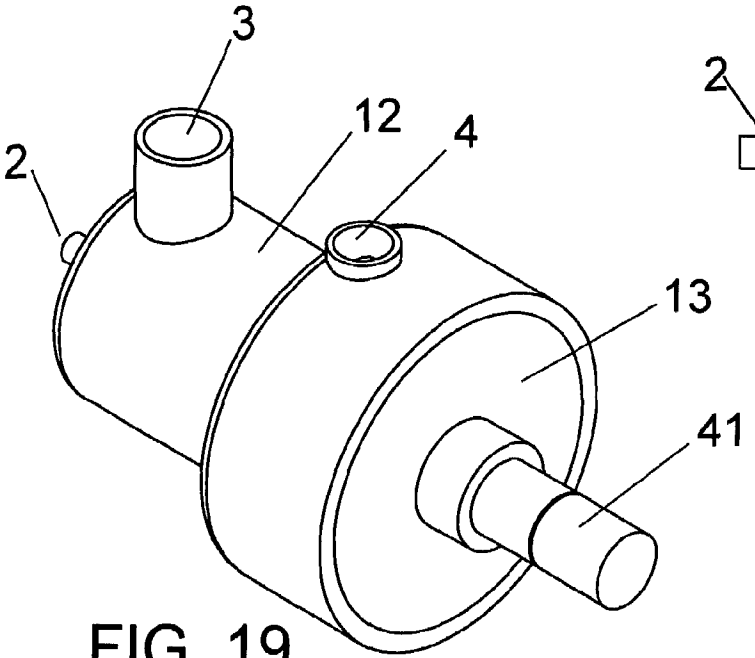
FIG. 19 is an external isometric view of the same embodiment shown in FIG. 16.

A third preferred embodiment is shown in FIGS. 14-21. In FIG. 17 is shown a pressure exchange ejector having a housing 1 comprising and upstream portion 12 and a downstream portion 13. Said upstream portion of housing 12 fixedly supports inlet conduit 2 which is shown integral with primary fluid nozzle 5. A compressible primary fluid is introduced through inlet conduit 2 and passes through supersonic primary nozzle 5. Said upstream portion of said housing 12 also includes a secondary fluid inlet conduit 3 and an outlet conduit 4 for the mixed fluid. The mass flow rate of nozzle 5 is determined by the cross-sectional area of the first throat 43 and the properties and thermodynamic conditions of the primary fluid. If the working fluid were to be air at a total temperature of 300° K., the nozzle 5 shown in FIG. 17 would result in an exit fluid Mach number of 3.0 if the primary total pressure exceeded the critical value to produce choked flow at the throat of the nozzle. Clearly a designer might select other nozzle configurations. Surrounding primary nozzle 5 is an aerodynamic shroud 10, supported in said upstream portion of housing 12, and configured so as to produce an annular flow passage 36 between said primary nozzle 5 and said shroud 10. Said annular flow passage 36 decreases in cross-sectional area beginning in the vicinity of the secondary fluid plenum 24, arrives at a minimum annular cross-sectional area, which can be termed the second throat 44, and then diverges to the exit plane of said primary nozzle 5. Such a configuration will produce a supersonic secondary flow at the exit plane of the primary nozzle 5, and said annular flow passage 36 can be alternately be termed the secondary annular nozzle 36 since, in this embodiment, it functions to accelerate the secondary fluid in the manner of a supersonic nozzle. For example, in the configuration shown in FIG. 17, if the working fluid were air at a total temperature of 300° K. and a supercritical upstream secondary total pressure, the secondary fluid would have a Mach number of approximately 1.75 at the exit plane of said primary nozzle 5. The advantage of accelerating the secondary fluid in this manner is to reduce the relative velocity between the primary and secondary fluids so as to minimize energy dissipation in the mixing layer separating said primary and secondary fluids in the region immediately downstream of said primary nozzle 5 since dissipation of energy in a shear layer is a function of the relative difference in velocity. Note that in this best mode configuration, both primary and secondary fluid flows are choked, so that the primary to secondary mass flow ratio for given primary and secondary fluid total pressures and total temperatures is determined by the geometric design. For the ejector shown in FIG. 17 with air as the working fluid with both primary and secondary total temperatures of 300° K., a primary total pressure of about 5 atm, a secondary fluid total pressure of about 1 atm, the design primary to secondary mass flow ratio is approximately 1.0. Obviously, this is just an example and in no way limits the scope of the invention. Depending on the application, the design mass flow ratio may be much higher or much lower. An objective of the third embodiment is to control mass flow ratio to design conditions.

A rotor 7, configured to rotate about its central axis, is placed with said axis of rotation coaxial with the central axis of said supersonic primary nozzle 5 immediately downstream of a conical forebody 6, the apex of which is approximately situated at the exit plane of said primary nozzle 5. The rotor 7 is pivotally mounted on the shaft of a spindle 42. Said spindle 42 is rigidly supported and sealed by said downstream portion of housing 13. Said spindle 42 may be motorized, but in the preferred embodiment, the rotor is self-driven aerodynamically so that said spindle only contains radial and thrust bearings and a pivotal output shaft (not shown.) In the preferred embodiment, these bearings should be as frictionless as possible. Gas bearings or compliant foil bearings are considered preferable to more conventional bearings. The half-angle of the conical forebody 6 shown in this embodiment is 10°. The rotor 7 of this embodiment is shown in detail in FIGS. 14, 15, and 16. In the configuration shown, said forebody 6 is integral with said rotor 7 and constitutes the leading portion of a base cone 27 upon which the ramp-shaped rotor vanes 18 are attached. However, other configurations might eliminate the forebody 6 entirely or incorporate it in a non-rotating separate forebody 6. In this embodiment, the rotor 7 has three vanes 18 which are configured as ramps with conical radially outward surfaces, said conical radially outward surface of said vane 18 having a cone angle which is greater than that of the forebody 6 and said base cone 27. The number of vanes would vary from two to any number, depending on the working fluid and the application. The optimal configuration would have to be determined for each individual application. In the rotor 7 shown in FIGS. 14-16, said conical radially outward surface of said vane 18 has a cone half-angle of 20°. As can be seen, the mathematical construction of the apex of the conical exterior surface of said vane 18 (not shown) is located on the axis of rotation of said rotor 7, but generally downstream of the apex of the base cone 27 which generally corresponds to the apex of the forebody 6. In this embodiment, the conical forebody 6 is of reduced relative length compared to the first embodiment rotor 7 shown in FIGS. 8-12 and the ramp shaped vanes 18 are initiated much closer to the apex of the forebody 6 because it is considered aerodynamically advantageous for many applications to initiate the pressure exchange process as close to the exit plane of said primary nozzle 5 as possible to prevent the growth of the mixing layer separating the primary and secondary fluids at the discharge of the primary nozzle 5 from interfering with the pressure exchange process. In some applications, the forebody 6 might be eliminated entirely by superimposing the apex of said base cone 27 with the apex of said conical exterior surface of said vane 18.

In FIGS. 14-18, it is seen that the vanes 18 are canted with respect to the axial-longitudinal plane. As with the first embodiment shown in FIGS. 8-10, the angle to which the vane makes with the axial-longitudinal plane varies with axial position. The scope of the invention includes any possible variation of the vane angle with axial position, however, the best mode is one which would not cause a tangential deflection of the primary fluid during the period in which a fluid particle is traversing the rotor flow path. This is to say that the best mode is the one in which the primary fluid velocity in the laboratory frame of reference is in the axial plane. This corresponds to the free-spinning speed of the rotor 7. The design procedure used to determine the vane angles corresponding to the design specified free-spinning speed is identical to that described for the first embodiment shown in FIGS. 7-10. For the rotors shown in FIGS. 14-18 with air at 300° K. and a Mach 3.0 primary fluid, the design free spinning speed is 150,000 rpm. It must be emphasized, however, that this invention is not limited to the free-spinning speed and would function as a flow induction device at any speed from zero to high speeds far exceeding the free-spinning speed. It is therefore understood that the spindle 42 may or may not include a motor means for adding energy to the rotor if desired. It is contemplated that the best mode is when the rotor is self-driving at the free-spinning speed, but the invention includes embodiments where a motor drives the rotor 7 at any arbitrary speed, or even where the rotor 7 is at rest.

Since, in the best mode, the rotor is not producing or receiving mechanical energy, and in the best mode is mounted on nearly frictionless bearings, when the supersonic fluid stream passes over said canted vanes 18, free-spinning rotation is imparted to the rotor 7. The rotational speed that the rotor acquires is dependent upon the thermo-physical properties of the fluid, the Mach number of the fluid emanating from supersonic nozzle 5, the included angle of the fore-body cone 6, and the vane angle of the vanes 18. While the best mode is one where the rotor 7 is self-driven, the invention anticipates that one may wish to drive the rotor by means of a motor/actuator at speeds greater than or less than the ideal free-spinning speed. The presence of undesirable friction will reduce the rotational speed of the rotor 7 from that of the ideal free-spinning condition, and one may wish to compensate for the dissipation in energy through bearing friction by means of a motor/actuator. When the supersonic fluid behind the fore-body shock and in the vicinity of the fore-body cone 6 contacts the leading edge of the ramped-shaped vane 18, a weak oblique vane-shock will form and the primary flow in the vicinity of the vanes will be deflected outwardly towards the shroud while the primary flow in the spaces between the vanes will continue to follow the conical contour 27 of the rotor. The flow pattern thus produced by the primary fluid will be such that a helix-shaped rotating body of primary fluid, extending radially between the rotor 7 and the shroud 10 will be formed.

As seen in FIG. 17, surrounding said rotor 7 is a shoud 10 having an annular portion termed the "pressure-exchange zone" 37. In this zone, the exchange of energy from the primary fluid to the secondary fluid through the process of pressure-exchange is mostly accomplished. Further downstream, additional energy exchange between primary and secondary fluids will occur by mixing until eventually the discharge fluid emanating from discharge conduit 4 is homogeneous. The shroud in the pressure-exchange zone 37 is designed so that the conical shock wave emanating from the apex of the forebody 6 does not impinge upon the shroud in the pressure-exchange zone 37. In the example shown for air where the nozzle 5 is a Mach 3.0 nozzle, standard references show that the shock angle for the 10° half angle forebody 6 is approximately 22°. One can then construct a line emanating from the apex of the forebody 6 at an angle of 22° to the axis of rotation and assure that the surface of the shroud in the pressure-exchange zone 37 lies outside this line. In this manner, the possible interference of a reflected shock wave on the pressure-exchange process will be lessened.

As seen in FIG. 17 in the vicinity of a zone labeled 38, downstream of the pressure exchange zone 37, the ramp-shaped vanes 18 of said rotor 7 are gradually transformed from being essentially conical to being essentially cylindrical on their radially outward surfaces. This shape is offered as a best mode, but in no way limits the range of shapes conceived of in the current invention. The shroud 10 in this zone 38 is caused to converge so as to form a supersonic diffuser zone 38 in the annular space between said cylindrical portion of said ramp-vane 18, decelerating both primary and secondary fluids to nearly sonic conditions. A third throat 39 is formed near the end of the supersonic diffuser zone 38 where the annular flow channel between the shroud 10 and the rear portion of rotor 7 attains a minimum cross-sectional area. Given the design mass flow rates, the third throat should be designed so as not to choke the flow since this might prevent choking upstream in the first or second throat. In the preferred embodiment, both primary and secondary fluids remain supersonic after the pressure exchange process is completed and must be brought to low speed subsonic conditions with minimum dissipation of energy as soon as possible to avoid further dissipation of energy inherent in high speed flows.

Figure 14:
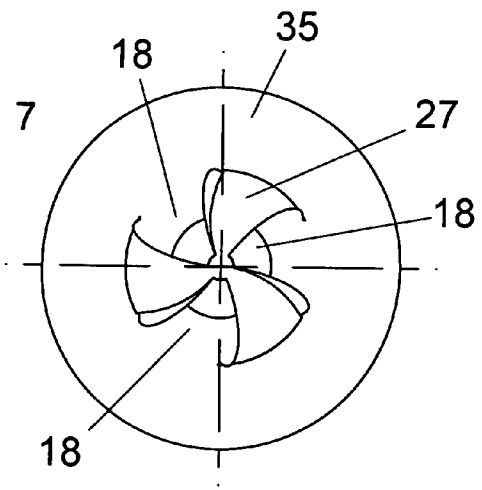
FIG. 14 is a front view of a representative third embodiment rotor.

As seen in FIG. 17 and in FIGS. 14-16, in the third preferred embodiment, after the combined primary and secondary fluids pass the third throat 39, the rotor 7 expands radially to form a skirt portion 35 whose function it is to deflect the combined fluids in the radial direction into a vaneless subsonic diffuser 40. The vaneless subsonic diffuser 40 is bounded by aerodynamic surfaces formed by the rear portion 40 of said shroud 10, the rear skirt 35 of said rotor 7, and the forward portion 46 of said downstream shroud 40. Since the flow is not choked in said third throat 39 but is designed to be of low Mach number slightly greater than unity, a weak normal shock will occur immediately downstream of said third throat 39 in the beginning of said vaneless diffuser section 40. The flow from then on is subsonic and will diffuse to a low speed as it enters the annular collector 41. The fluid is then discharged from the ejector through outlet conduit 4.

Objectives of the third embodiment are that in order to avoid the dissipation of energy, the processes of pressure-exchange and mixing should occur in as short a flow path as possible, shock wave reflection should not be permitted in the pressure exchange zone 37 by proper design of the shroud 10 in the pressure-exchange zone 37, shock waves should be made weak either by the production of oblique shocks as they occur over forebody 6, or by weak normal shocks as they occur when slowing the fluid to transonic conditions by the third throat 39; and, the relative velocities between primary and secondary fluids should be kept as small as is feasible as seen at the exit plane of nozzle 5.

Figure 22:
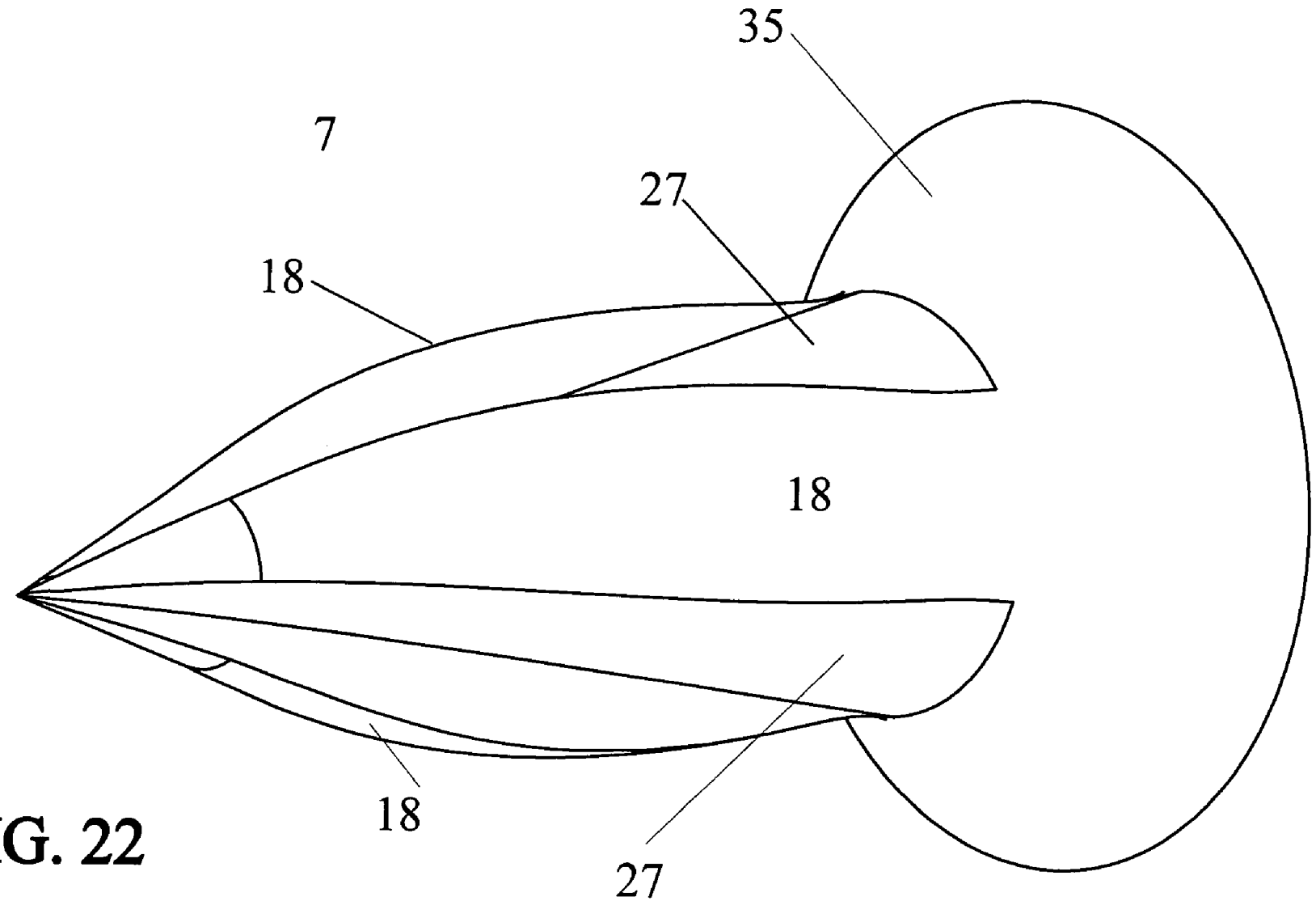
FIG. 22 is an isometric view of a rotor for a fourth embodiment.

A fourth embodiment is shown in FIG. 22, whereby rotor 7 has no forebody. The other details of the ejector 1 are identical to that of the third embodiment shown in FIG. 17. The fourth embodiment rotor 7 of FIG. 22 has radially outer surface of the vanes 18 which lie on an imaginary first cusped body of revolution, while the radially outer portion of the base body 27 lies on a second imaginary cusped body of revolution which is radially inward from said first cusped body of revolution. The cusps of said first body of revolution and said second body of revolution are coincident. The helix angles of the fourth embodiment ramp-shaped vanes 18 of the rotor 7 are designed in precisely the same manner as for the first and third embodiments. In this embodiment, when a supersonic stream emanates from nozzle 5 and impinges on said superimposed cusps of rotor 7, a stepped oblique shock pattern will be attached to the leading portion of said rotor. One oblique shock pattern will correspond to the cusp cone angle of the first cusped body of revolution corresponding to the exterior surfaces of vanes 18, the other will correspond to the cusp cone angle of the base body 27, both shock patterns attached to the point where both cusps coincide. In the example shown in FIG. 22 when the fluid is air, the primary Mach number is 3.0, the first body of revolution corresponding to the outer surface of the vanes 18 has a cusp cone half-angle of 20°, the second body of revolution, corresponding to the base body 27, has a cusp cone half-angle is 10°, the oblique shock angle over the vanes would be approximately 30°, while the oblique shock angle over the base body 27 would be approximately 22°. Since in this example there are three vanes, the shock pattern would appear to have three teeth. As with the third embodiment, the design should avoid having these shocks impinge against the wall of the shroud 10 in the pressure exchange zone 37. The objective of this embodiment is to initiate the pressure exchange process as far upstream as possible to avoid adverse effects caused by the growth of the mixing layer, and to make the device as short and compact as possible.

A fifth embodiment generally has the same geometry as the first four embodiments, but has the primary fluid introduced annularly through inlet conduit 3 and coaxial nozzle 36 in FIG. 17, while the secondary fluid is introduced through inlet conduit 2 and then to the nozzle 5. In the best mode, nozzles 5 and 36 would be designed so that the primary fluid Mach number is greater than the secondary Mach number.

The invention claimed is as follows:

1. A pressure-exchange ejector (1) having a housing (11) with a primary fluid inlet conduit (2), a secondary fluid inlet conduit (3), and a mixed-fluid outlet conduit(4); and, a nozzle (5) fixedly mounted within said housing (11), receiving fluid from said primary fluid inlet conduit (2), which accelerates said primary fluid to form a stream at the nozzle discharge; and, said secondary fluid inlet conduit (3) in communication with a plenum (24) which is internal to said housing (11) and surrounds the downstream end of said nozzle (5); and, an aerodynamic shroud (10) which receives said secondary fluid from said plenum (24) and directs said secondary fluid towards said primary fluid so as to affect pressure-exchange between said primary and secondary fluids; and, a spindle (14) rigidly mounted to said housing (11); and, a rotor (7) pivotally connected to said spindle (14), said rotor (7) having an axi-symmetric revolute body and including a plurality of vanes (18) fixed to said revolute body, and, an essentially conical forebody (6) placed directly upstream of said rotor (7);

the improvement comprising:

said rotor (7) having the form of a base (27) with the shape of the frustum of a cone whose included angle is approximately equal to that of said forebody (6) and having ramp shaped vanes(18) fixedly integrated on said rotor base (27) axi-symmetrically about the central longitudinal axis of rotation, said ramp-shaped vanes bounded by an essentially conical outer surface of revolution whose included angle is greater than that of said forebody (6).

2. A pressure-exchange ejector (1) according to claim 1 wherein said primary fluid is a compressible fluid and said nozzle (5) is a supersonic nozzle.

3. A pressure-exchange ejector (1) according to claim 1 wherein said secondary fluid is a compressible fluid.

4. A pressure-exchange ejector (1) according to claim 1 wherein said forebody (6) and said rotor (7) are fixed to each other and rotate in unison.

5. A pressure-exchange ejector (1) according to claim 1 wherein said forebody is conical.

6. A pressure-exchange ejector (1) according to claim 1 wherein said ramp-shaped vanes are canted at a helix-angle greater than zero degrees to enable aerodynamic rotation by the primary fluid.

7. A pressure-exchange ejector (1) according to claim 6 wherein said helix angle is a function of the local rotor radius measured from the axis of rotation of said rotor (7), and is calculated to produce free-spinning rotation of the rotor (7).

8. A pressure-exchange ejector (1) according to claim 1 wherein the rotor (7) is non-rotating.

9. A pressure-exchange ejector (1) according to claim 1 wherein said aerodynamic shroud (10) cooperates with the external surfaces of said primary nozzle (5) so as to form secondary annular nozzle (36) to accelerate said secondary fluid prior to pressure-exchange.

10. A pressure-exchange ejector (1) according to claim 9 wherein said secondary annular nozzle (36) has a cross-sectional which decreases in area in the direction of flow to a throat (44) and then increases in area so as to produce a supersonic secondary flow at the exit plane of said primary nozzle (5).

* * * * *